US005558461A

United States Patent [19]

Van Dorp

[11] Patent Number: 5,558,461

[45] Date of Patent: Sep. 24, 1996

[54] TUBULAR GUTTER SYSTEM

[75] Inventor: Arie Van Dorp, Hazerswoude Dorp, Netherlands

[73] Assignee: Arvado Patent B.V., Hazerswoude, Netherlands

[21] Appl. No.: 295,906

[22] PCT Filed: Mar. 10, 1992

[86] PCT No.: PCT/NL92/00046

§ 371 Date: Nov. 14, 1994

§ 102(e) Date: Nov. 14, 1994

[87] PCT Pub. No.: WO93/18239

PCT Pub. Date: Sep. 16, 1993

[51] Int. Cl.[6] ..... E02B 13/00

[52] U.S. Cl. ..... 405/43; 47/62; 47/17

[58] Field of Search ..... 405/36, 43, 45, 405/47, 52, 270; 47/1 F, 12 R, 18, 62; 52/13, 14

[56] References Cited

U.S. PATENT DOCUMENTS

| | | | |
|---|---|---|---|
| 3,625,011 | 12/1971 | Stevenson . | |
| 3,679,242 | 7/1972 | Hess . | |
| 3,733,832 | 5/1973 | Bailey . | |
| 3,753,352 | 8/1973 | McNally . | |
| 4,596,491 | 6/1986 | Dietzler . | |
| 4,878,782 | 11/1989 | Beattie et al. . | |
| 4,973,196 | 11/1990 | Fuhr et al. | 405/270 X |
| 5,197,238 | 3/1993 | Peleg | 52/15 X |

FOREIGN PATENT DOCUMENTS

| | | | |
|---|---|---|---|
| 0133414 | 2/1985 | European Pat. Off. . | |
| 1491929 | 8/1967 | France . | |
| 2705667 | 8/1978 | Germany . | |
| 8804832 | 5/1988 | Germany . | |
| 3833878 | 4/1990 | Germany | 47/18 R |
| 9015464 | 1/1991 | Germany . | |
| 2192655 | 1/1988 | United Kingdom . | |
| 2208465 | 4/1989 | United Kingdom . | |

*Primary Examiner*—William P. Neuder
*Attorney, Agent, or Firm*—Young & Thompson

[57] ABSTRACT

System for draining a land surface (10) which is covered by a waterproof membrane (12), whereby tubular gutters (14) are installed in trenches in the land surface (10) adjacent to the margins of the waterproof membrane (12) and whereby the land surface (10) is slightly sloped such that water falling onto the membrane (12) will flow in a natural manner in the direction of a gutter (14). Each tubular gutter (14) can be assembled from one or more interconnected tubes each comprising one or more aligned apertures (16, 18, 20) in the upwards directed wall section. The marginal section of the membrane (12) adjacent to the aligned row of apertures (16, 18, 20) in the tubular gutter wall is attached to the tubular gutter (14) by suitable elements (17, 22, 32) such that water flowing along the membrane (12) will be received in the gutter.

22 Claims, 7 Drawing Sheets

TUBULAR GUTTER SYSTEM

FIELD OF THE INVENTION

The invention relates to a system for collecting water from a surface which is covered by a waterproof membrane, whereby tubular gutters are installed in trenches in the surface adjacent to the margins of the waterproof membrane and whereby the surface is slightly sloped such that water on the membrane will flow in a natural manner in the direction of a gutter, each tubular gutter comprising apertures through which water may enter the gutter.

A system of this type is described in the German Gebrauchsmuster DE 8804852. This prior art system is especially destined for use at the bottom of a waste disposal dump. In such applications, one has to take care that no solids will reach the inside of the gutter whereas any fluid seeping through the mass of solid waste has to be collected on the membrane on the bottom of the dump and should flow from there through the apertures into the tubular gutter. For that purpose the apertures are embodied as relatively small apertures aligned in two rows each in one side wall of the gutter just above connection ridges or flaps extending from the respective side wall and destined to become attached to the marginal section of the membrane at the respective side of the gutter. The top half of the gutter is closed to avoid entrance of any solids.

The invention is not directed to systems for use underground such as the above-mentioned system, but is directed to systems for use at ground level.

Other systems are also known from the state of the art, for instance for application in sports areas, tennis courts, etc. Examples thereof are described in the German Patent DE 465,166 and in the European Patent Application EP 0 072 559. In all these systems, the waterproof membrane comprises a foil of plastic material, whereby separate drainage gutters or drainage tubes are used to receive water from this foil and to drain said water. In all these prior art systems the foil is furthermore covered with a top layer of soil, which may have a thickness of some tenths of centimeters and which gives the area the appearance of a tennis court, a football field or something like that.

In the German Patent DE 465,166 no further special measures are taken to obtain a watertight connection between the membrane and the drainage tubes. Therefore part of the water flowing along the waterproof membrane will not he received in the gutter but will penetrate into the ground. Furthermore, the prior art gutters are made in situ from stone or concrete and are therewith expensive and not relocatable.

In the European Application EP 0 072 559 there is no separate gutter. In stead, the gutter is formed by positioning the marginal section of the membrane in a gutter-shaped trench or excavation, which is made specially for that purpose. Because in that way the gutter lining is made from the marginal section of the membrane itself, this membrane should he relatively thick and stiff for that purpose to maintain its shape during further use and to assure a certain degree of form stability. However, thick and stiff membranes are hard to handle especially when it comes to covering a preshaped land area with a relatively broad length of such a membrane. Moreover, it seems practically impossible to use this last-mentioned method for obtaining a long gutter with a length of several hundred meters which has a continuous fall of for instance a few centimeters per hundred meter gutter length.

In plant growing farms, in which plants, shrubs, trees, etc. are grown outside in pots or in other containers, rainwater and sprinkle water which is not absorbed by the plants or by the soil in the pots or containers will reach the underlying soil and will penetrate therein. That will convert the soil to a muddy substance, especially in case of heavy rainfall or plenty of sprinkling water, deteriorating the working conditions for the grower. A more serious disadvantage resides in the fact that in general nutrients, pesticides or other substances will be added to the sprinkling water. These additives will penetrate into the soil and will accumulate therein forming a potential environmental hazard.

Experiments are carried out momentarily with land surfaces which are covered by a waterproof membrane such as a plastic web or foil. Thereby first of all the land surface is preshaped to form a slightly inclined ramp or slope such that rainwater or sprinkle water (together with eventual additives), which falls on the membrane, will flow in a natural manner in the desired direction to the margin of the membrane where the water is received in a gutter. Through this gutter the water may for instance flow into an accumulation reservoir. In such systems the membrane is not covered by an other layer of soil such as in the above-mentioned state of the art, but forms as such the top layer which directly receives and drains rainwater and sprinkle water to the gutter system.

During the practical realization of such a system various problems are encountered. Dependent on the form and the material of the gutter it appeared to be more or less difficult to obtain in a simple manner a watertight connection between the margin of the membrane and the gutter in such a manner that in principle all the water, which falls on the membrane and flows along the membrane in the direction of the gutter, will indeed be collected in the gutter. However, with reference to the above-mentioned environmental hazard caused by the accumulation of pesticides and nutrients into the earth, a reliable and easy to make watertight transition between the membrane margin and the gutter, assuring that all water flowing along the membrane will reach the gutter and in principle no water will penetrate into the ground, is of outmost importance.

The construction of the gutter should be easy and quick. Therefore, generally available cheap but reliable materials are preferred in stead of concrete or stone gutter elements such as known from the prior art.

The used membranes, especially embodied as monolayers or multilayers of a suitable plastic material, are preferably selected so strong and thick that it is possible to walk upon and to drive over it with light conveying materials, such as wheelbarrows, etc. However, on the other hand to improve the handling of the membrane and to reduce the pure material costs the membrane is selected so thin and light of weight that, if no further measures are taken, the membrane can be lifted off and blown away easily by the wind. That has to be prevented.

SUMMARY OF THE INVENTION

An object of the invention is now to eliminate these disadvantages and to provide a system which assures in a cheap and efficient manner the drainage of water from a land surface which is covered by a waterproof membrane.

In this respect the invention now provides a system of the type mentioned in the first paragraph of this specification which according to the invention is characterised in that the apertures in each tubular gutter of the system, which is destined to collect water from the upper surface of a piece of land, are present in the upwards directed wall of the tube and have an elongated shape with a largest dimension in length direction of the tube, whereby the marginal section of the membrane adjacent to said apertures is attached to the wall of the tubular gutter at or directly adjacent to the edge of each aperture such that water flowing along the membrane will be received in said gutter.

Instead of a number of elongated apertures it is also possible to make one single aperture in the tube in the form of an elongated slit.

The fact that the apertures are present in the upper wall of the gutter, i.e. that the gutter is open at the top, has the advantage that it is very easy to clean the gutter from leaves, twigs, compost particles or other material which may fall in the gutter during normal operation. Cleaning could be done for instance by using a pressurised water jet or other suitable means.

For attaching the marginal section of the membrane to the wall of the tube various alternatives are conceivable. According to one embodiment the marginal section of the membrane is attached to the wail of the tubular gutter by means of an adhesive.

According to another embodiment the marginal section of the membrane is attached to the wall of the tubular gutter by means of a melting process whereby the membrane and the wall of the tubular gutter are locally heated to above the weakening temperature.

According to a further embodiment the marginal section of the membrane is attached to the wall of the tubular gutter by means of mechanical fasteners such as screws or rivets.

According to a preferred embodiment the marginal section of the membrane is folded around the edge of the respective aperture in the tubular wall whereafter the membrane is attached to the tubular wall by clamping means.

Preferably, the tubular gutter is made from PVC-tubes or other suitable tubes, which are known to the expert in this field, in which tubes the desired apertures are made. In that case standard auxiliary means and standard coupling means can be applied for interconnecting a number of tubes into a longer tubular gutter system. Furthermore standard bends, knees, etc. can be applied and the connection of the tubular gutter system to a further drainage channel for further transporting the accumulated water does not give any problem.

To assure a correct positioning of the gutter system, especially with respect to the gradual and continuous fall of the gutter, it is preferred that the tubular gutters are supported by foundation piles. More specifically the tubular gutters are attached to said foundation piles by means of screws or nails extending through a predrilled hole in the lower wall of the tube whereby additional measures are taken to prevent leakage of water through said predrilled hole.

Furthermore in case the tubular gutter is assembled from two or more interconnected tubes it is preferred that a coupling sleeve is used receiving the end sections of both tubes to be interconnected, whereby a water blocking non solid material such as a greasy or jelly substance is used to obtain a water tight connection between the sleeve and the end of a tube.

BRIEF DESCRIPTION OF THE DRAWINGS

The invention will be explained in more detail with reference to the attached drawings.

DETAILED DESCRIPTION OF THE INVENTION

Figure 1:
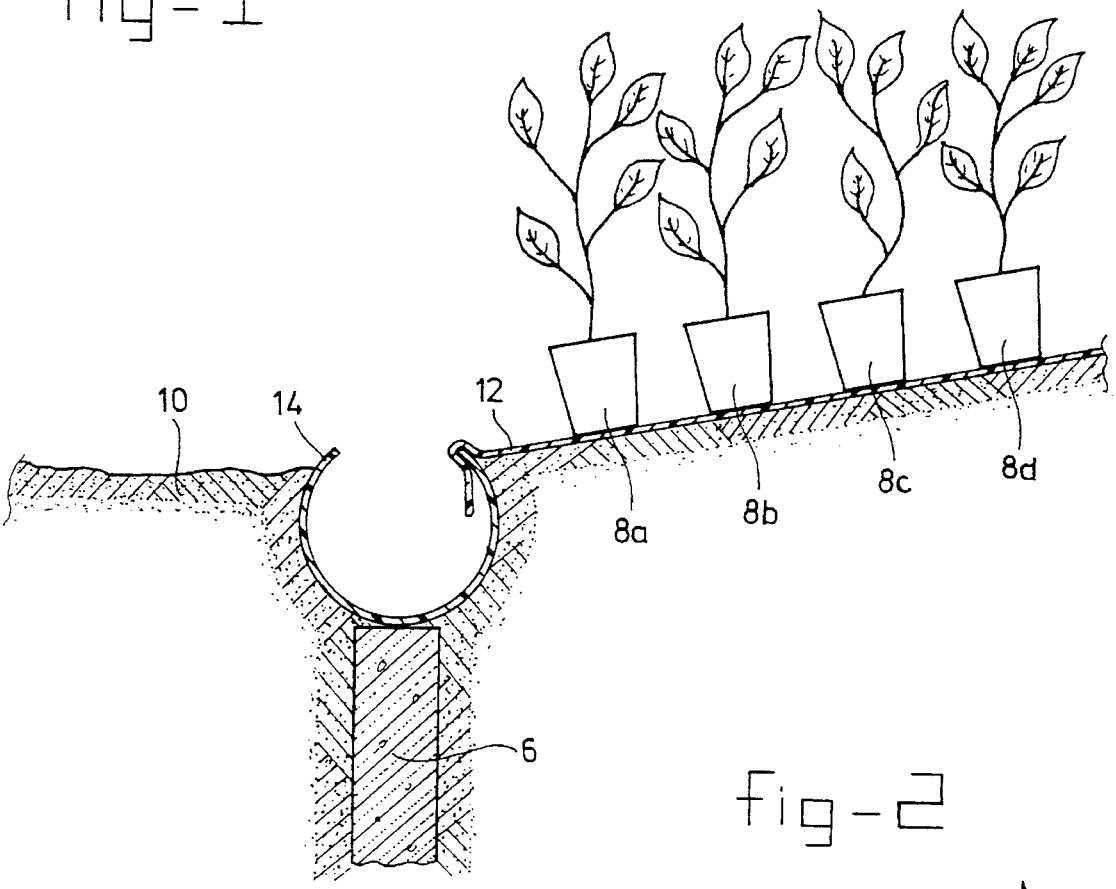
FIG. 1 illustrates a cross section through a system comprising a tubular gutter connected to the edge of a membrane.

FIG. 1 illustrates a cross section through a soil layer 10, of which the upper side is at least partly covered by a waterproof membrane 12. On top of the membrane 12 potted plants can be positioned as is illustrated schematically by the pots 8*a* . . . 8*d*. Before the membrane 12 is laid out, the upper side of the bottom layer 10 is shaped into such a sloping configuration that rainwater or sprinkling water, which falls onto the membrane 12, will be drained into the direction of a gutter 14.

The gutter 14 is almost completely dug into the ground and consists of an elongated tube which comprises at the top side one or more apertures, The marginal section of the membrane 12 is folded around the edge of the tube 14 in said aperture and is attached to the edge of the tube in a way which is not illustrated in detail in this figure. More details of the tube 14 and the attachment of the membrane to the tube will be explained with reference to other figures.

As schematically indicated the tube 14 is supported by a number of foundation piles 6 to assure a correct position of the tube over a long time period. Such a pile foundation is certainly preferred in case the under&round 10 has a weak, soft consistency. However, even if the underground consists for instance of sand or another relatively stable material such a foundation is very helpful in obtaining the desired continuous fall of for instance only a few centimeters per 100m length.

In the system according to FIG. 1 rainwater or sprinkling water, which falls onto the membrane 12, will be drained to the tube 14, but rainwater which falls on the left side of the tube 14 will mainly penetrate into the ground 10.

Figure 2:
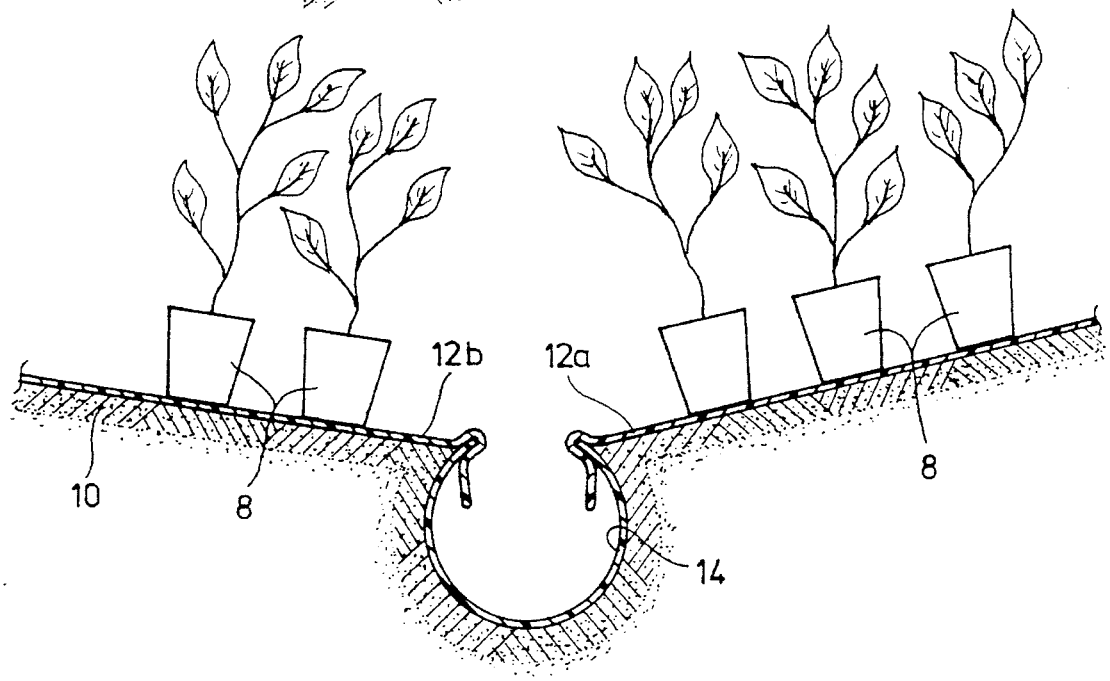
FIG. 2 illustrates a system in which the tubular gutter is connected to two membranes at both sides of the gutter.

If it is desired to drain the land at both sides of the tube 14, then one can opt for a system variant which is illustrated in FIG. 2. In this figure the area right of the tube 14 is covered by the membrane 12*a* and the area left of the tube 14 is covered by the membrane 12*b*. At both sides of the tubular gutter 14 potted plants 8 can be positioned, as is schematically illustrated in the figure, whereby for the sake of clearness only one of the potted plants has a reference number. The edges of both membranes 12*a* and 12*b* are folded into the aperture in the tubular wall 14 and are attached to the edges of said wall by means which are also not illustrated in detail in this figure. Assuming that the slope of the area is such that all rainwater and sprinkling water which falls onto the membrane 12*a* or onto the membrane 12*b* will in a natural manner flow in the direction of the gutter 14, then this system assures that rainwater and sprinkling water at both sides of the tube 14 will be received into said tube and will not penetrate into the soil 10.

Figures 3A, 3B, 3C:
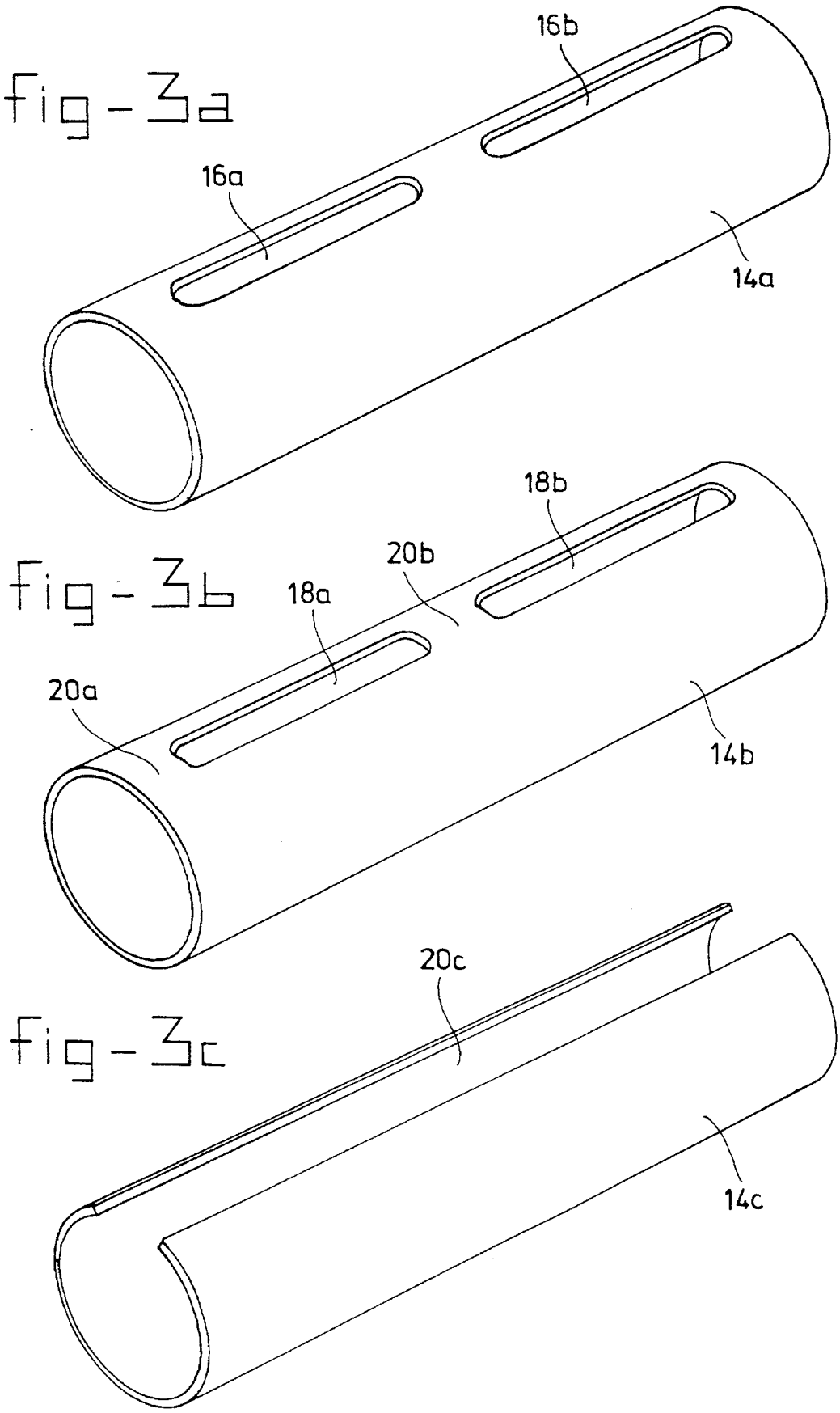
FIG. 3*a* illustrates a first embodiment of a tubular gutter for application in a system according to the invention.
FIG. 3B illustrates a second embodiment of a tubular gutter for application in a system according to the invention.
FIG. 3C illustrates a third embodiment of a tubular gutter for application in a system according to the invention.

In the FIGS. 3A, B, C, D and E a number of possible variants of tubes are illustrated which can be applied into a system according to FIG. 1 or FIG. 2.

The tube 14*a* in FIG. 3A consists of a tube with round cross-sectional shape, preferably made of PVC or an other suitable plastic material, whereby in the upper wall of the tube a series of elongated apertures 16*a*, 16*b*, . . . is made. The elongated apertures 16*a*, 16*b* . . . are in this embodiment made with semicircular end sections.

In the embodiment illustrated in FIG. 3B the tube 14*b* also comprises a series of elongated apertures 18*a*, 18*b*, . . . which in this embodiment, however, have a rectangular shape. The fabrication of such rectangular shapes requires more effort than the fabrication of apertures with semicircular end sections as illustrated in FIG. 3A. However, the rectangular apertures 18*a*, 18*b* in FIG. 3B have the advantage that the intermediate bridges 20*a*, 20*b*, 20*c* have uniform dimensions and have therefore a maximum strength. These bridges are necessary to assure that under normal use, in the conditions as illustrated in FIGS. 1 and 2, the opposite walls of the tube are not pressed together by the pressure in the soil at both sides of the tube. Preferably the corners of the rectangular apertures are rounded off to avoid the formation of cracks and tears.

FIG. 3C illustrates an embodiment in which the tube 14*c* comprises one elongated slit 20*c* with a predetermined width. To assure that this tube maintains its shape under operative conditions notwithstanding the pressure of the surrounding soil, use will be made of bridge parts, bridging the aperture at a number of places as will be discussed in more detail hereinafter. The advantage of the embodiment is FIG. 3C is, that the fabrication of one elongated slit in the tube a relatively easy mechanical operation which can be carried out in a simple manner.

Figure 3D:
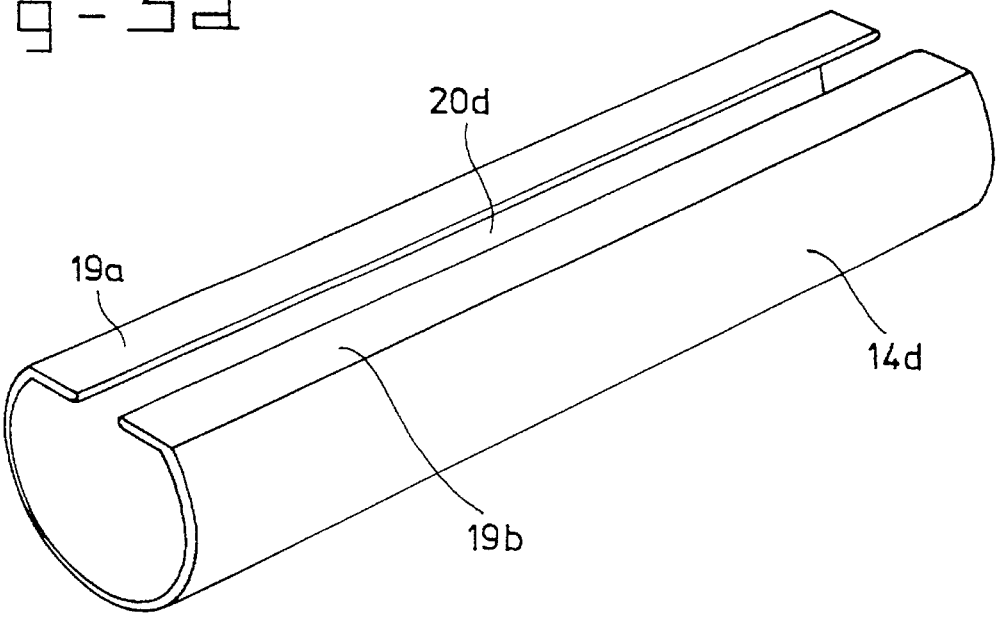
FIG. 3D illustrates a third embodiment of a tubular gutter for application in a system according to the invention.

FIG. 3D illustrates another embodiment in which the tube 14*d* comprises one elongated slit 20*d* with a predetermined width. The upper part of the tube is flat so that the slit 20*d* is bounded by flat wall sections 19*a* and 19*b* which under operative conditions will extend almost horizontally. These horizontal wall sections are very suited to connect the marginal section of the membrane as will be explained in detail. Also this embodiment of the tube is preferably used in combination with bridge parts to assure that the tube maintains its shape under operative conditions notwithstanding the pressure of the surrounding soil.

Figure 3E:
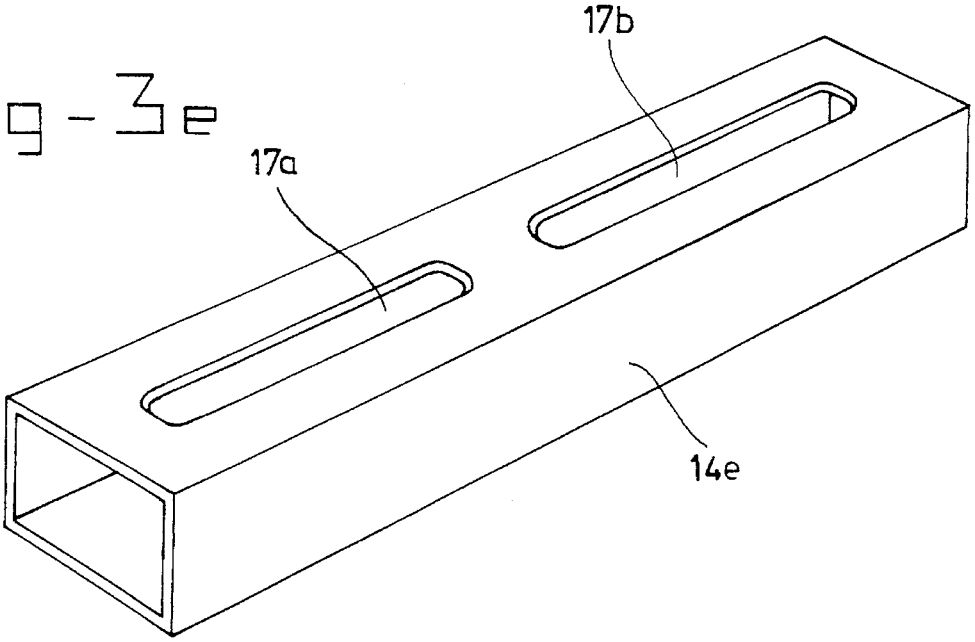
FIG. 3E illustrates a third embodiment of a tubular gutter for application in a system according to the invention.

The tube 14*e* in FIG. 3E consists of a tube with rectangular cross-sectional shape, preferably made of PVC or an other suitable plastic material, whereby in the upper wall of the tube a series of elongated apertures 17*a*, 17*b*, . . . is made. The elongated apertures 17*a*, 17*b*, . . . are in this embodiment made in the same shape as illustrated in FIG. 3B. However, it will be clear that various other aperture shapes are conceivable, such as rectangular apertures with semicircular end sections, one elongated slit or even a series of circular apertures.

Figure 4:
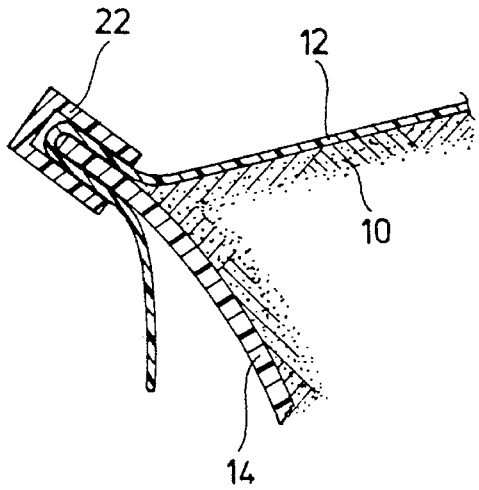
FIG. 4 illustrates in a more detailed manner an embodiment of the clamping means for attaching the membrane to the edge of the tubular gutter.

FIG. 4 illustrates in more detail the way in which the marginal part of the membrane can be folded around the edge of the aperture in the tube 14 and can be attached thereto. As appears from FIG. 4 the marginal part of the membrane 12 is folded around the edge of the tube 14 and is clamped on it by positioning a clamping element 22 over the folded membrane section. It will be clear that the dimensions or the clamping element have to be selected such that the desired clamping action is indeed obtained.

Figure 5:
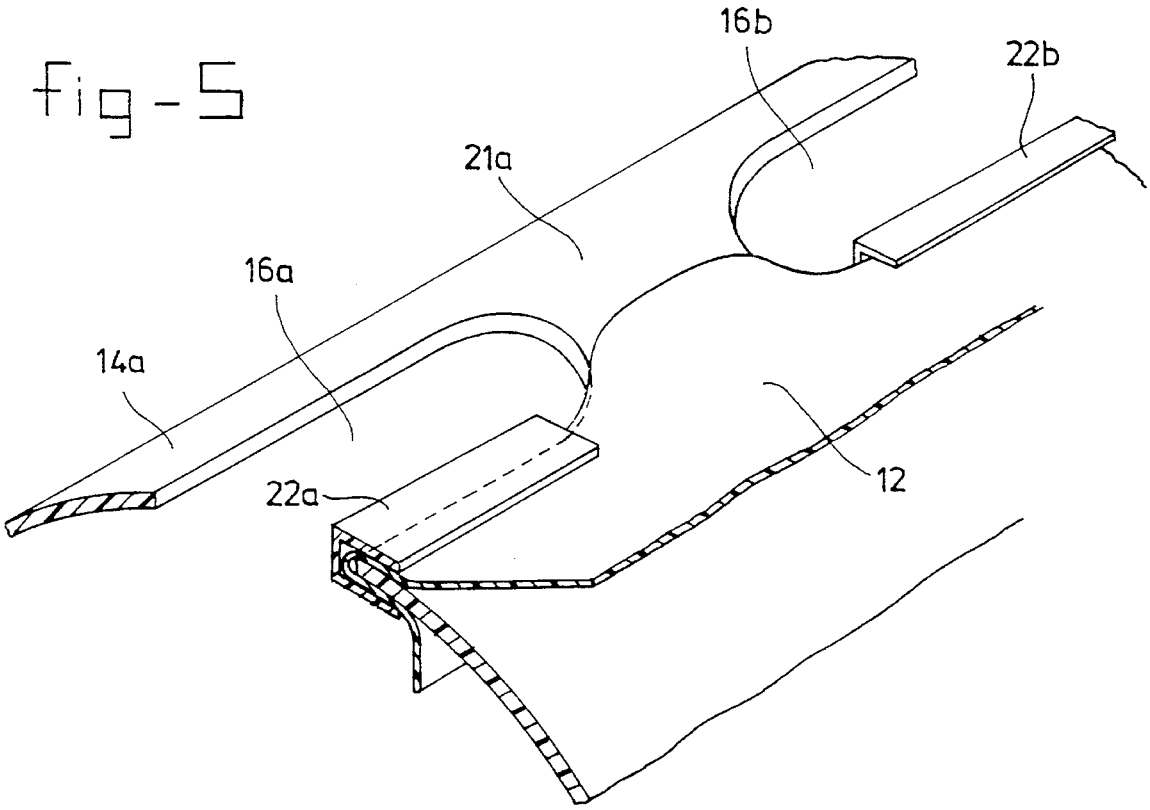
FIG. 5 illustrates in a perspective view more details of the manner in which the foil is clamped around the tubular gutter, assuming that the tubular gutter has the embodiment as illustrated in FIGS. 3A or 3B.

FIG. 5 illustrates in a perspective view the situation when a tube of the type illustrated in FIG. 3A is applied. FIG. 5 shows two of the apertures 16*a* en 16*b* in the tube with the intermediate connecting bridge 20*a*. For attaching the membrane 12 two skewed incisions are made in the marginal section of the membrane at the location of the bridge section 21*a* in such a manner that it is possible to fold the marginal section of the membrane around the edge of the apertures 16 and 16*b*, whereby at the location of the connecting bridge 20*a* a piece of the marginal section of the membrane remains resting onto the connecting bridge. Thereafter the elongated clamping elements 22*a* and 22*b* are attached such that the membrane 12 is clamped to the tube 14*a*. The clamping elements 22*a*, 22*b* may consist of U-shaped profiles of aluminum or a suitable resilient plastic material. The U-shape might be rectangular such as in FIG. 4 is indicated, but may also comprise rounded edges.

Figure 6:
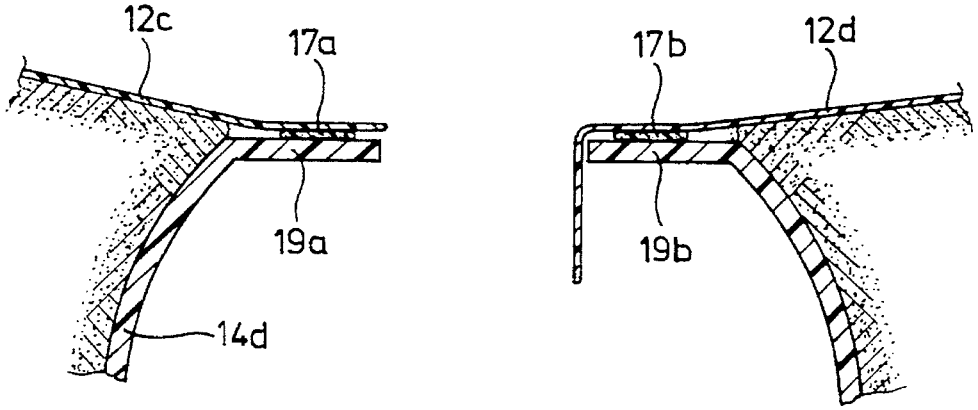
FIG. 6 illustrates the use of adhesive to attach the marginal section of the membrane to the tubular gutter.

FIG. 6 illustrates the use of an adhesive to obtain a proper connection between the marginal section of the membrane and the upper wall of the tube. The illustrated tube has the shape which is described with reference to FIG. 3D. The marginal sections of the membranes 12*c* and 12*d* are adhered to the horizontal wall sections 19*a* and 19*b* respectively by means of a layer of adhesive 17*a* and 17*b* respectively. After adhering the marginal membrane section to the tube 14*d* the eventual projecting part of the marginal section can be cut off as is shown for the left hand membrane 12*c* or can be left hanging in the tube 14*d* as is shown for the right hand membrane 12*d*. Because the upper wall sections 19*a* and 19*b* are extending horizontally the part of each membrane adhered thereto will also extend horizontally avoiding thereby the formation of a slight indentation as is present in the embodiment illustrated in FIG. 4.

Figure 7:
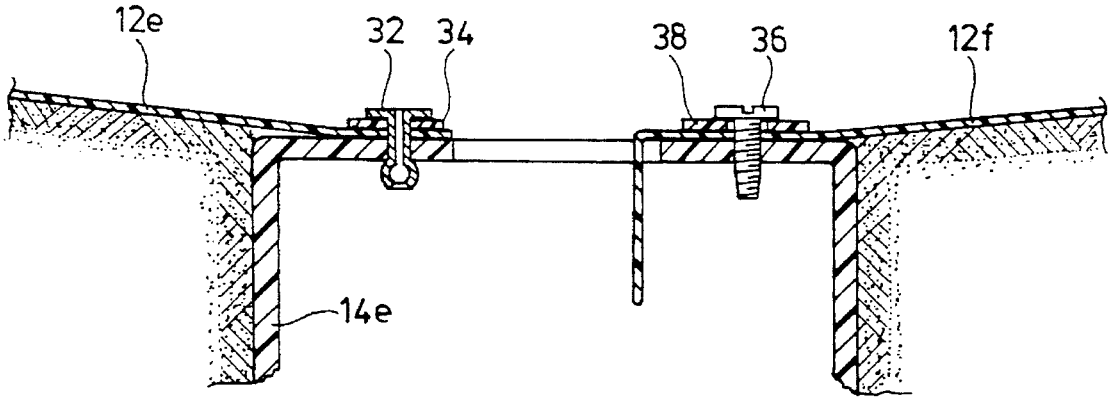
FIG. 7 illustrates the use of mechanical fastening means such as screws or rivets to attach the marginal section of the membrane to the tubular gutter.

FIG. 7 illustrates the application of mechanical fastening means such as screws or rivets in combination with a tube of the type illustrated in FIG. 3E. The membrane 12*e* at the left hand side of the figure is attached to the tube 14*e* by means of a blind rivet 32. To extend the clamping action of the rivet 32 preferably a washer 34 of relatively large dimensions is used in the illustrated manner. The membrane 12*f* at the right hand side of the figure is fixed to the upper wall of the tube 14*e* by means of a screw 36 which is screwed into a predrilled hole in the wall. Preferably, a relatively large washer 38 is used to extend the clamping area of the screw 36. Just as in FIG. 6 one has the choice between cutting of the eventual projecting part of the membrane, as is done with membrane 12*e*, and let the overlapping part of the membrane hang down in the tube, as is done for membrane 12*f*.

Figure 8A:
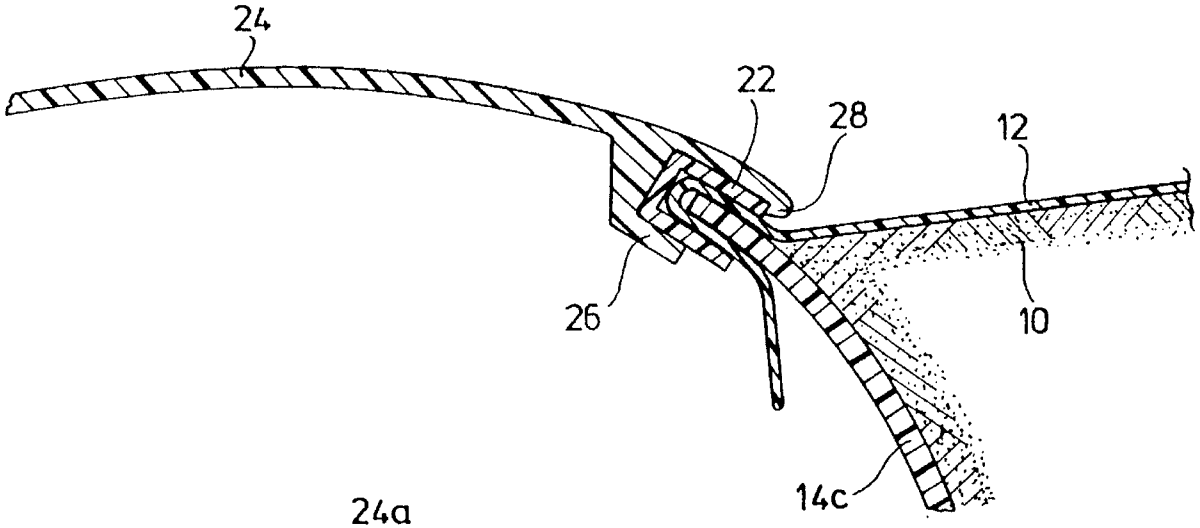
FIGS. 8A and 8B illustrate the application of separate bridge parts for fixing the edges of the tubular gutter, especially in case the tubular gutter is embodied as illustrated in FIG. 3C.

FIG. 8A illustrates the manner in which by means of separate bridge parts 24 the form stability of the tube, when using especially the embodiment 14*c* illustrated in FIG. 3C, can be assured. The way in which the membrane 12 is folded around the edge of the tube 14*c* and is attached thereto by means of the clamping element 22, is as such already described with reference to FIG. 4. After positioning the clamping strips 22 the bridge part 24 is snapped over the aperture in the tube 14*c*. For that purpose the bridge part 24 comprises two legs 26 (one of which is visible in the figure), which snap around the clamping elements 22. Preferably the end sections of the bridge part resting upon the clamping means 22 are provided with a hook 28 snapping around the clamping means 22. Because of these hooks 28 the bridge part 24 assures that the tube will maintain its circular shape and will not be pressed together or will be bent open.

Figure 8B:
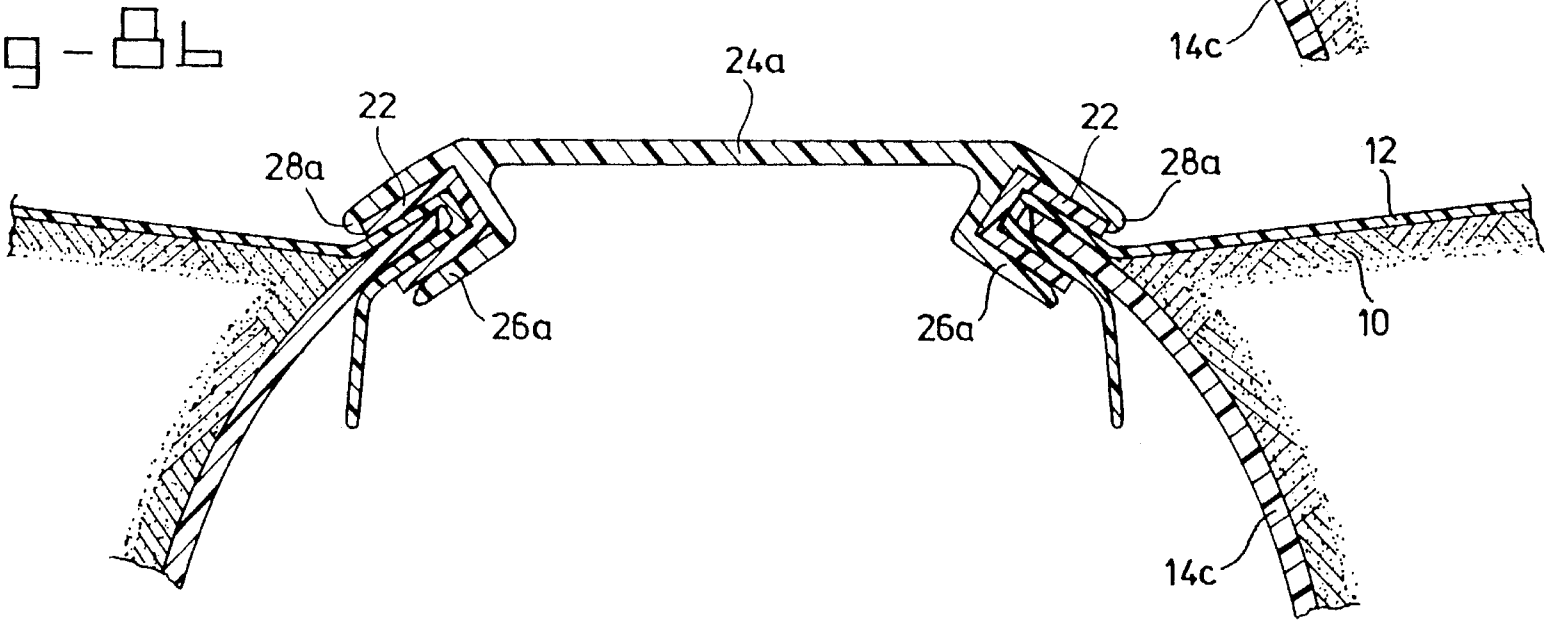

The central part of the bridge section 24 can have a bent shape such as illustrated in FIG. 8A, the radius of the bend being the same as the radius of the tube 14*c*, but may also be embodied as a flat section as illustrated in FIG. 8B.

The flat bridge part 24*a* in FIG. 8B is apart from the flat central section almost identical to the bridge part illustrated in FIG. 8A. After positioning the clamping strips 22 the bridge part 24*a* is snapped over the aperture in the tube 14*c*. For that purpose the bridge part 24*a* comprises two legs 26*a*, which snap around the clamping elements 22. Preferably the end sections of the bridge part resting upon the clamping means 22 are provided with a hook 28*a* snapping around the respective clamping means 22.

Figure 9A:
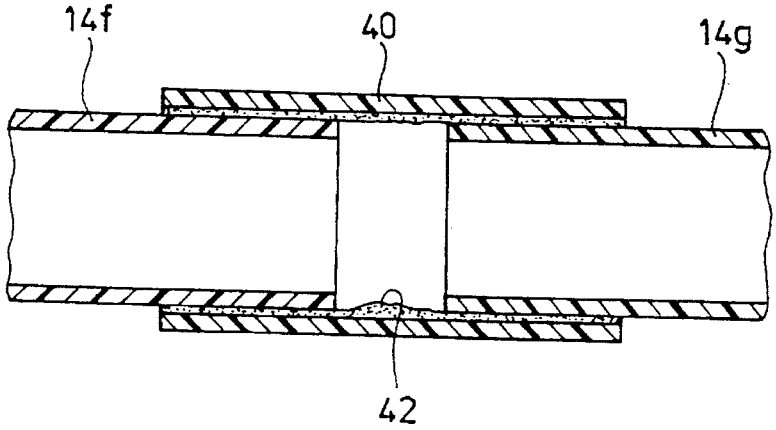
FIG. 9A illustrates a coupling between two tubes.
Figure 9B:
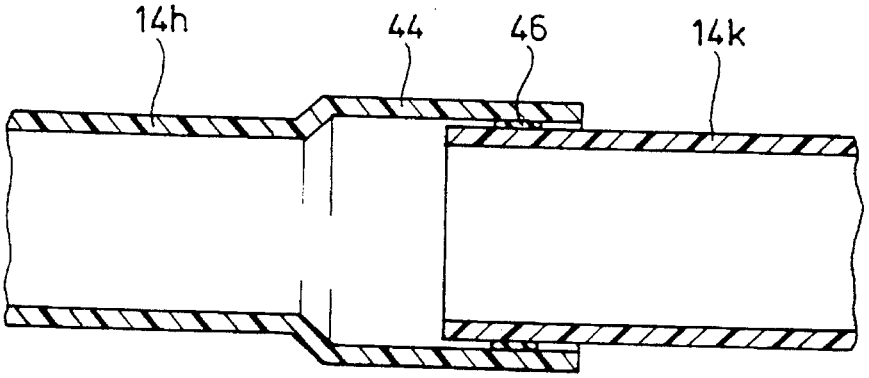
FIG. 9B illustrates another coupling between two tubes.

The coupling between two tubes is illustrated in a cross-sectional view in FIGS. 9A and 9B. The tubes 14*f* and 14*g* in FIG. 9A are coupled through the coupling sleeve 40. Taking into account the fact that the tubes can have a considerable length such as 5 or 10 meters it is preferred to maintain a gap between the tubes 14*f* and 14*g* as shogun in FIG. 9A providing space for extension of the tubes as the environmental temperature rises. Because dependent of the material of the tubes the length thereof may vary with temperature preferably the tubes are not fixed to the coupling sleeve but are loosely inserted in said sleeve whereby to obtain a watertight non leaking coupling a greasy or fatty substance is applied between the inner wall of the sleeve and the adjacent parts of the tubes 14*f* and 14g, which substance is indicated by 42 in FIG. 9. A suitable greasy substance is for instance vaseline.

In FIG. 9B the coupling sleeve 44 forms an integral part of one of the tubes 14*h*. Between the inner wall of the sleeve section 44 and the outer wall of the other tube 14*k* a sealing ring 46 of a flexible material such as rubber is installed to assure the watertightness of the connection.

During installation of a system according to the invention first of all trenches are made to accommodate the tubular gutters. Thereafter a series of foundation piles is pressed with predetermined mutual distance into the ground whereby care is taken that the top surfaces of said piles together determine a slightly sloping line. Thereafter the tubes are positioned on top of the row of foundation piles whereby connections between the tubes are made as described above. Preferably the tubes are fixed to the foundation piles by suitable fastening means such as nails or screws in combination with rubber washer or other suitable means to prevent leakage. In stead of nails or screws an adhesive can be used to adhere the bottom wall of the tube to the top surface of the foundation pile.

Thereafter the remaining spaces at both sides of the tubular gutter are filled with soil and the whole terrain is preshaped such that the desired slopes are obtained. Then the membrane is rolled out and the margins thereof are fastened to the tubular gutter in the above described manner.

I claim:

1. In a system for collecting water from a surface which is covered by a waterproof membrane, whereby tubular gutters are installed in trenches in the surface adjacent to the margins of the waterproof membrane and whereby the surface is slightly sloped such that water on the membrane will flow in a natural manner in the direction of a gutter, each tubular gutter comprising apertures through which water may enter the gutter, the improvement wherein the apertures in each tubular gutter of the system are present in an upwardly directed wall of the tubular gutter and have an elongated shape with a largest dimension in length direction of the tubular gutter, whereby a marginal section of the membrane adjacent to said apertures is attached to the wall of the tubular gutter at or directly adjacent to an edge of each aperture such that water flowing along the membrane will be received in said gutter.

2. System according to claim 1, wherein the elongated apertures in the tubular wall have semi-circular end sections.

3. System according to claim 2, wherein the elongate apertures in the tubular wall have a rectangular shape with rounded-off corners.

4. System according to claim 1, wherein each tubular gutter comprises one aperture in the form of an elongated slit.

5. System according to claim 1, wherein the marginal section of the membrane is attached to the wall of the tubular gutter by means of an adhesive.

6. System according to claim 1, wherein the marginal section of the membrane is attached to the wall of the tubular gutter by means of a melting process, whereby the membrane and the wall of the tubular gutter are locally heated to a temperature above the weakening temperature.

7. System according to claim 1, wherein the marginal section of the membrane is attached to the wall of the tubular gutter by means of mechanical fasteners such as screws or rivets.

8. System according to claim 1, wherein at each aperture, the marginal section of the membrane is folded around the edge of the respective aperture in the tubular wall, whereafter the membrane is attached to the tubular wall by clamping means.

9. System according to claim 8, wherein the clamping means are formed of U-shaped profiles, having a length not longer than the length of an aperture, said profiles being clamped onto the edge of the respective aperture after folding the membrane around said edge.

10. System according to claim 8, wherein bridge parts, each spanning the width of an aperture, can be attached to both edges of the aperture or to the clamping means to maintain the marginal section of the membrane folded around the respective edge of the aperture.

11. System according to claim 10, wherein the bridge parts are embodied such that they can be installed using a snap connection attaching the respective ends of the bridge part to the edge of the respective aperture.

12. System according to claim 1, wherein the tubular gutters have a circular cross section.

13. System according to claim 1, wherein the tubular gutters have a rectangular cross section.

14. System according to claim 13, wherein corners of the rectangular cross section are rounded off.

15. System according to claim 1, wherein the tubular gutters have in general a circular cross section whereby the wall sections adjacent to apertures are approximately flat and in the operative condition positioned approximately horizontal.

16. System according to claim 1, wherein the tubular gutters are made of a plastic material.

17. System according to claim 1, wherein the tubular gutters are supported by foundation piles.

18. System according to claim 17, wherein the tubular gutters are attached by suitable means to said foundation piles.

19. System according to claim 18, wherein the tubular gutters are attached to said foundation piles by means of screws or nails extending through a predrilled hole in a lower wall of the tubular gutter whereby additional measures are taken to prevent leakage of water through said predrilled hole.

20. System according to claim 1, wherein the tubular gutter is assembled from at least two tubes interconnected by a coupling sleeve which receives end sections of both tubes to be interconnected, and a water-blocking nonsolid material is used to obtain a watertight connection between the sleeve and the end of a tube.

21. System according to claim 20, wherein the sleeve forms an integral part of one of the tubes to be connected.

22. System according to claim 20, wherein a predetermined distance is maintained between the ends of both tubes when making an interconnection between two tubes providing space for temperature-dependent expansion of the tubes.

* * * * *